US010060252B1

(12) United States Patent
Keller

(10) Patent No.: US 10,060,252 B1
(45) Date of Patent: Aug. 28, 2018

(54) METHOD FOR MAPPING OF FLOW ARRIVALS AND OTHER CONDITIONS AT SEALED BOREHOLES

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 368 days.

(21) Appl. No.: 14/529,576

(22) Filed: Oct. 31, 2014

Related U.S. Application Data

(60) Provisional application No. 61/897,942, filed on Oct. 31, 2013.

(51) Int. Cl.
*E21B 47/10* (2012.01)

(52) U.S. Cl.
CPC ..... *E21B 47/1015* (2013.01)

(58) Field of Classification Search
CPC ..... E21B 47/1015
See application file for complete search history.

(56) References Cited

U.S. PATENT DOCUMENTS

| | | | | |
|---|---|---|---|---|
| 4,778,553 | A | 10/1988 | Wood | |
| 5,176,207 | A | 1/1993 | Keller | |
| 5,246,862 | A | 9/1993 | Grey et al. | |
| 5,377,754 | A | 1/1995 | Keller | |
| 5,803,666 | A | 9/1998 | Keller | |
| 5,804,743 | A | 9/1998 | Vroblesky et al. | |
| 5,853,049 | A | 12/1998 | Keller | |
| 6,026,900 | A | 2/2000 | Keller | |
| 6,109,828 | A | 8/2000 | Keller | |
| 6,244,846 | B1 | 6/2001 | Keller | |
| 6,283,209 | B1 | 9/2001 | Keller | |
| 6,910,374 | B2 | 6/2005 | Keller | |
| 7,281,422 | B2 | 10/2007 | Keller | |
| 7,753,120 | B2 | 7/2010 | Keller | |
| 7,841,405 | B2 | 11/2010 | Keller | |
| 7,896,578 | B2 | 3/2011 | Keller | |
| 8,069,715 | B2 | 12/2011 | Keller | |
| 8,176,977 | B2 | 5/2012 | Keller | |
| 8,424,377 | B2 | 4/2013 | Keller | |
| 8,596,354 | B2 * | 12/2013 | Hartshorne | E21B 47/1015 166/250.12 |
| 9,008,971 | B2 | 4/2015 | Keller | |
| 2005/0109087 | A1 * | 5/2005 | Robb | E21B 47/1015 73/53.01 |
| 2014/0220563 | A1 * | 8/2014 | McCann | C12Q 1/68 435/6.11 |

(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — Giovanna C. Wright
*Assistant Examiner* — Manuel C Portocarrero
(74) *Attorney, Agent, or Firm* — Rod D. Baker

(57) ABSTRACT

A method and system for performing fluid flow tracing through a medium, such as the geologic formation surrounding a subterranean borehole, or the environment around a pipe or conduit. A transparent liner is everted into the borehole. A marker fluid from the surrounding medium emerges from the wall of the borehole and is allowed to contact the liner, or a cover of the liner, to create a stain thereon that is visible with a camera lowered into the liner interior.

4 Claims, 7 Drawing Sheets

(56) References Cited

U.S. PATENT DOCUMENTS

| | | | |
|---|---|---|---|
| 2014/0262346 | A1 | 9/2014 | Keller |
| 2014/0262347 | A1 | 9/2014 | Keller |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

Plan view

Fig. 6a
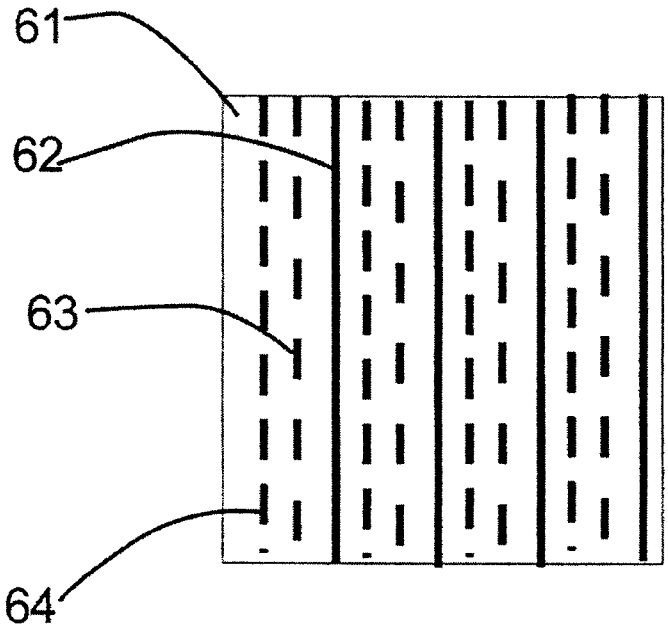
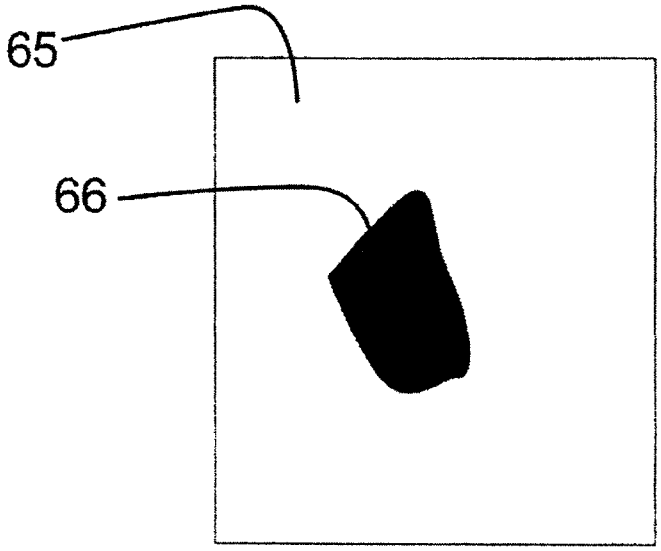
Fig. 6b

METHOD FOR MAPPING OF FLOW ARRIVALS AND OTHER CONDITIONS AT SEALED BOREHOLES

CROSS-REFERENCE TO RELATED APPLICATIONS

This application claims the benefit of the filing of U.S. Provisional Patent App. Ser. No. 61/897,942 filed 31 Oct. 2013 and entitled "Method for Mapping of Flow Arrivals at Sealed Boreholes," the entire specification of which is incorporated herein by reference.

BACKGROUND OF THE INVENTION

Field of the Invention

This invention relates to the measurement of flow paths in a geologic formation using a video camera observation of stains caused by the flow arrival at the wall of the sealed observation borehole.

Background Art

A borehole is a hole, e.g., a drilled shaft, into the Earth's subsurface. The hydraulic conductivity profiling techniques described in my U.S. Pat. Nos. 6,910,374 and 7,281,422 have been used to map flow zones in over 300 boreholes since 2007. These patents, whose complete teachings are hereby incorporated by reference, describe the flexible liner installation procedure by the eversion process. Other installations of flexible liners into boreholes by the eversion of the liners are used for a variety of patents held by this inventor, including U.S. Pat. Nos. 6,283,209 and 6,244,846. However, the methods described in the above patents are not measurements of the geologic flow characteristics using a transparent borehole liner.

A wide variety of methods currently are used to deduce the flow characteristics between adjacent boreholes. Those methods include electrical resistance tomography and acoustic tomography. Flow characteristics also are sometimes deduced by injecting dye into one borehole hole and then measuring dye arrival in one or more neighboring observation boreholes using a variety of sampling methods, including either open observation borehole or by observation at isolated intervals in the observation borehole. Other methods use pressure transmission between the boreholes to infer the flow connections. Most of these measurements are done in open holes without a seal of the observation borehole wall.

The mapping of transport paths in geologic media is important to a wide variety of endeavors, such as determination of available ground water supplies or in the prediction of the transport of contaminated ground water to municipal water supply wells. The remediation of contaminated ground water also needs an understanding of subsurface flow paths.

The observation of stains on a reactive cover of a borehole liner, without removal of the liner, is useful to the method described my U.S. Pat. No. 6,298,920, which is incorporated herein by reference. Also, my U.S. Pat. No. 7,896,578 discloses a system and method which wicks by diffusion into an activated carbon felt any contaminants from the pore space of a borehole wall. However, the apparatus of the '758 patent very preferably should be left in place in the borehole for at least about two weeks to adsorb a replica of the contaminant distribution. In favorable contrast, the liner and cover according to the present disclosure need not be in place for more than approximately one hour to obtain useful visible stains. A transparent liner in the present invention allows the dye reaction of the NAPL FLUTe to be observed (via camera) frequently during the two week period that the device of the '578 patent must remain in place in the borehole.

With the foregoing background, the presently disclosed invention was developed to allow a time-dependent measurement of fluid arrival at specific locations in the geologic medium at an observation borehole wall, using a transparent sealing borehole liner. The liner preferably is installed by eversion. Because the observation borehole is sealed with a liner, the fluid motion in the formation is not affected by flow in the observation borehole, nor by withdrawal of fluid from the surrounding medium of the observation borehole as is done in some tracer studies. The ability to evaluate the evidence of the presence of an injected fluid, or other fluids of interest, in a geologic medium in space and time has many uses in the conceptual development of the flow patterns in the subsurface formation, as well as in the detection of particular fluids of concern (such as contaminants).

SUMMARY OF THE DISCLOSURE

There is disclosed a method and apparatus to line a borehole with an essentially transparent tubular liner, and then to evaluate flow paths in the formation or environmental material around the borehole. In this disclosure and in the claims, "borehole" refers to subterranean boreholes in the earth's surface, as well as to artificial pipes and conduits above of or below the earth's surface. The valuation is accomplished using a camera observation of stains or reactions caused by the flow arrival, at the wall of the sealed observation borehole, of a marker fluid. The liner is slightly larger in diameter than the observation borehole, and is pressurized with an interior fluid pressure so as to urge the liner into intimate contact with the borehole wall. In many applications, the liner interior fluid is water, but alternately may be air or some other usually transparent fluid.

When a heavily dyed fluid, such as a potassium permanganate solution (a very dark purple colored mixture), is pumped into an open borehole nearby the observation borehole, the solution mixture flows (as possible) through the available flow paths between the two boreholes, such as permeable beds or fractures in a rock formation. After such a marker fluid arrives at the sealed observation borehole, a video camera traverse of the interior of the lined borehole allows detection of the staining marker mixture as it contacts the exterior of the transparent liner. The contact may be with a (possibly non-transparent) cover layer on the outside of the liner, which cover layer may be a fabric or other flexible material which the marker fluid can penetrate, absorb into, or adsorb onto. Subsequent video scans from the the interior of the liner show later arrivals at other locations (e.g., different elevations) in the geologic medium intersected by the observation borehole. The timing and amount of staining of the borehole liner allows the deduction of the transport flow rate and approximate pathways traveled by the injected marker fluid. Optionally but additionally, the provision of a variety of coverings on the outside of the transparent liner permits the detection of chemical or other reactions between marker fluid and the cover layer material, or of the presence or time of arrivals of reactive fluids at the wall of the borehole.

BRIEF DESCRIPTION OF THE DRAWINGS

The attached drawings, which form part of this disclosure, are as follows:

FIGS. 6*a* and 6*b* illustrate the stains caused by TCE contact with a NAPL FLUTe cover material which can be seen through a transparent cover; FIG. 6*a* shows a portion of an outside (i.e., facing toward a borehole wall) surface of a liner cover layer according to the present invention, and FIG. 6*b* shows an inside (i.e., facing toward a borehole interior) surface of a liner cover layer.

DETAILED DESCRIPTION OF THE INVENTION

Figure 1:
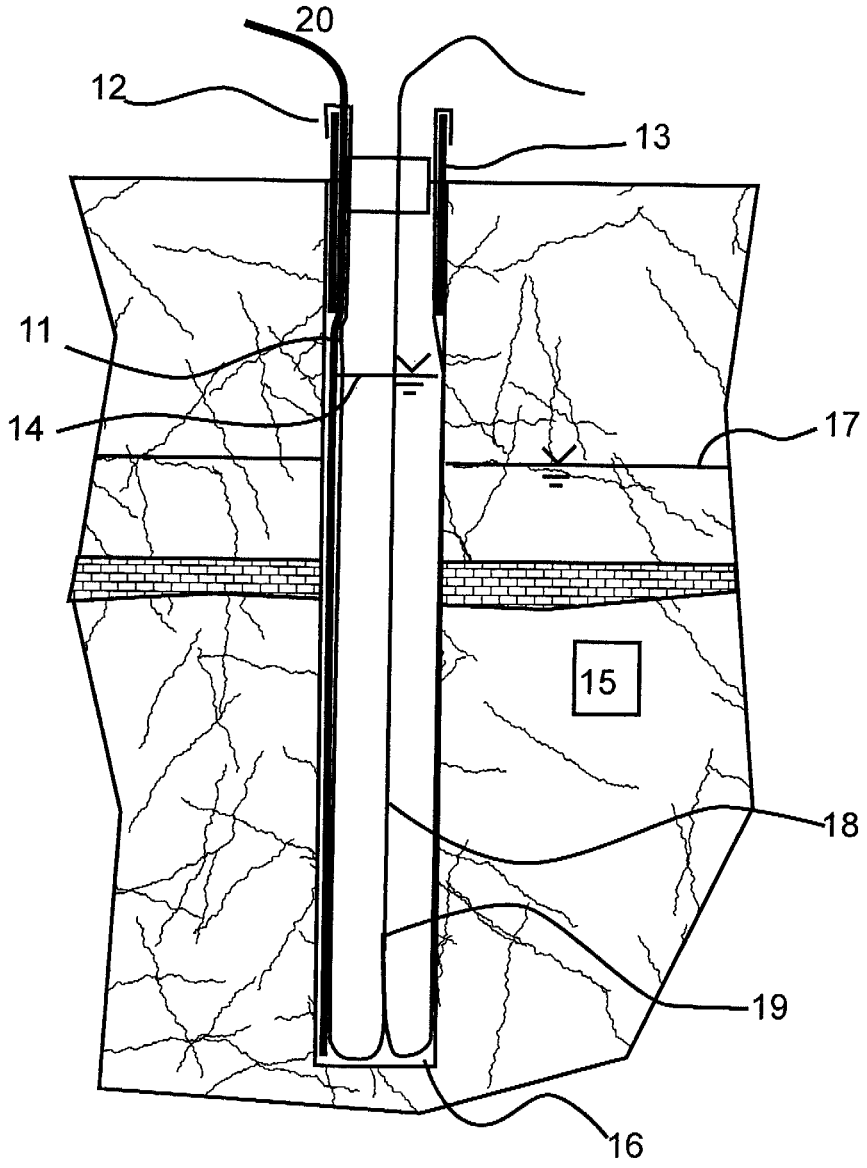
FIG. 1 is a side elevation sectional schematic view of the of the everting liner emplacement in an observation borehole according to the present disclosure.

There is provided according to the present disclosure an apparatus and method for detecting and mapping the arrivals of marker fluids or dyes at a subsurface borehole, thereby permitting deduction and evaluation of flow patterns or routes in subsurface geologic media. Other beneficial applications of the apparatus and method are disclosure or are apparent to a person of ordinary skill in the art. In this disclosure and in the claims, "borehole" means subterranean boreholes drilled in the earth's surface, as well as to artificial pipes and conduits above or below the earth's surface. Thus, while the invention is intended primarily for use in subsurface boreholes (including monitoring and injection wells), it may also find beneficial application with man-made pipes or conduits in buildings or in the ground, to detect and/or evaluate fluid flows from the surrounding environment to the pipe or conduit.

The method and apparatus involve a marker fluid used for tracing flow paths in subterranean geologic formations, which marker fluid produces a visible discoloration outside the transparent liner when the marker fluid emerges from the borehole wall boundary of the formation. Alternatively, the apparatus and method are practiced in the same manner as to detect flow paths in a subterranean geologic formation, but instead for the purpose of detecting leak paths in piping or conduit systems (in the ground or in the environment of a building structure) after the liner according to this disclosure has been everted into the interior of the pipe or conduit in the same manner as it is everted into a subterranean borehole.

The method is for detecting flow arrivals and other conditions at a borehole. Flow arrivals are the arrival, at a borehole wall, of fluid flow through a surrounding media, such as a fractured or permeable geologic formation. The flowing fluid carries a marker fluid that renders viewable the arrival of the fluid flow, as it emerges from the borehole wall. A preferred embodiment of the method includes the steps of (1) everting into an observation borehole a flexible, substantially transparent, liner for contacting a wall of the observation borehole; (2) disposing a camera within an interior of the everted liner; and (3) observing with the camera, and through the transparent liner, an event or condition where the liner contacts the observation borehole wall. The event may be, and preferably is, the arrival of the fluid flow at the observation borehole, or the staining of a liner cover by the marker fluid as it arrives at the borehole. Alternatively, if there is no opaque cover on the liner, a geologic formation condition, such as fracturing, mineral type or condition, etc.) can be observed directly through the transparent portion of the liner.

The method preferably includes moving the camera (e.g., up and down) within the interior of the everted liner. Such movement permits imagery to be captured and recorded (and/or transmitted) by the camera from different locations (especially elevations) within the borehole. The camera optionally may be rotated to obtain 360-degree circumferential views/images, or may have more than one lens, to capture image data about the circumference of the observation borehole at a selected elevation. In the method, "everting into an observation borehole" includes everting into an artificial pipe or conduit a flexible substantially transparent liner for contacting a wall of the pipe or conduit. The camera in such a case is moved longitudinally in the pipe or conduit.

Everting a substantially transparent liner preferably includes the step of providing the transparent liner with a cover layer that comes into contact with the observation borehole wall. The preferred embodiment of the method preferably further comprises the steps of allowing a marker fluid to emerge from the observation borehole wall to create at least one stain on or in the cover layer, and then viewing the at least one stain with the camera. The observation borehole may be monitored, by continuous or repeated observation with the camera, to view creation of a plurality of stains on or in the cover layer.

The method preferably includes the step of noting the location, in the observation borehole, of the creation of the at least one stain. The location (e.g., elevation) of the camera within the borehole is knowable from the distance (length of camera tether cable) the camera has been lowered or raised within the liner interior and within the borehole. Thus the image of a given borehole event or condition (e.g. image of a marker fluid stain on the liner cover) captured by the camera are directly correlated to the location in the borehole of that event or condition. Moreover, if the camera is positioned adjacent to an event or condition at the time the event or condition is created, the method may include noting the time of the creation of the event (e.g., the creation by a marker fluid of at least one stain).

In a preferred embodiment of the method, the observation borehole is in a subsurface formation, and the method further comprises the steps of injecting a marker fluid into an injection borehole in a subsurface formation, and awaiting the movement of the marker fluid, through the subsurface formation (e.g., via subterranean cracks, fissures, permeable stratum/strata, or other flow transmission modes or means) from the injection borehole to the observation borehole wall. By injecting a marker fluid into an injection borehole, and awaiting and observing/noting its arrival (within a fluid flow) at one or more geohydrologically associated observation boreholes, the extent, location, orientations, and configuration of subterranean fluid flow paths can be traced and determined, or at least estimated and generalized for purposes of characterizing and evaluating subterranean hydrogeology.

The method preferably includes providing on the exterior of the everted liner a cover layer comprising a material that receives the marker fluid to create at least one stain on or in the cover layer. "Receives" refers to penetration, adsorption, and/or absorption, such that the marker fluid generates on or in the cover layer a stain that is visible under ordinary or specialized (e.g., ultraviolet or infrared) wavelengths of light. Alternatively the liner's cover layer may comprise a material that reacts with the marker fluid to create at least one stain on or in the cover layer. Thus, the marker fluid may create a stain by staining the liner cover layer directly, or may react with the liner cover layer to create a stain. A known marker fluid may be injected into an injection borehole, or a pre-existing marker fluid identified (e.g., one or more contaminants known to preexist and flow within the subsurface formation), and the liner cover layer is then deliberately comprised of a material known in the art to react (e.g., chemically) with the specifically known marker fluid. Any number of known combinations of marker fluid reagents and reactive liner cover layer compositions/ingredients, may be suitably adapted for use in the present method; some typifying examples are offered later herein.

Accordingly, the when a created liner stain is viewable under light in the visible spectrum, the method step of observing with a camera comprises viewing the stain with a camera recording images from the visible spectrum. When a created liner stain is viewable under light in the infrared spectrum, the step of observing with a camera comprises viewing the stain with a camera recording images from the infrared spectrum. When a created liner stain is viewable under light in the ultraviolet spectrum, the step of observing with a camera comprises viewing the stain with a camera recording images from the ultraviolet spectrum.

A typical everting liner installation is shown in FIG. 1. A borehole 16 is shown in sectional view and penetrates the subsurface formation 15. The flexible liner 11 is attached to the casing 13 at casing top 12. The liner 11, which in a preferred embodiment of the apparatus and method is composed of a flexible and substantially transparent plastic, is everted down the borehole 16. The liner 11 in the borehole is filled with a filler fluid, typically water, to the liner fluid level 14, which is above the water table 17 in the formation 15. As the liner 11 is everted down the borehole 16, water within the borehole but beneath/outside the liner is displaced into available flow paths in the formation 15 as the liner propagates by eversion of the liner at the bottom end of the liner. The driving pressure to evert the liner 11 is due to the difference between the pressure head at the liner fluid level 14 and the pressure head in the formation 15 associated with the water table 17.

If the head in the formation 15 is higher than the head within the liner, the liner 11 collapses under the formation water pressure, and the liner will not propagate. A minimum head difference between level 14 and level 17 thus is required to cause the liner 11 to deform properly by the eversion process. The driving pressure is greater to evert a liner into relatively smaller borehole diameters than for larger diameter boreholes. In some situations, such as when the borehole transmissivity is insufficient to allow all the ambient water beneath the liner 11 to be readily displaced into the surrounding formation 15, a tube 20 is emplaced between the exterior of the liner 11 and the borehole wall, and extending to the bottom of the borehole 16, to permit evacuation of the water from beneath the liner.

For the liner to be easily everted, the water table 17 in the open borehole must be sufficiently deep below the top 12 of the surface casing to allow adequate filling of the liner 11 thereby to drive the eversion process. For some boreholes, the minimum depth to the water table 17 in the formation 15 may be, for example, about five feet below the top 12 of the casing 13. In other situations involving smaller-diameter boreholes, the water table 17 may need to be about twenty feet below the top 12 of the casing 13. The precise details of the liner installation for all circumstances are not needed to explain the ordinary liner installation, which is described in my patents cited previously herein.

Figure 2:
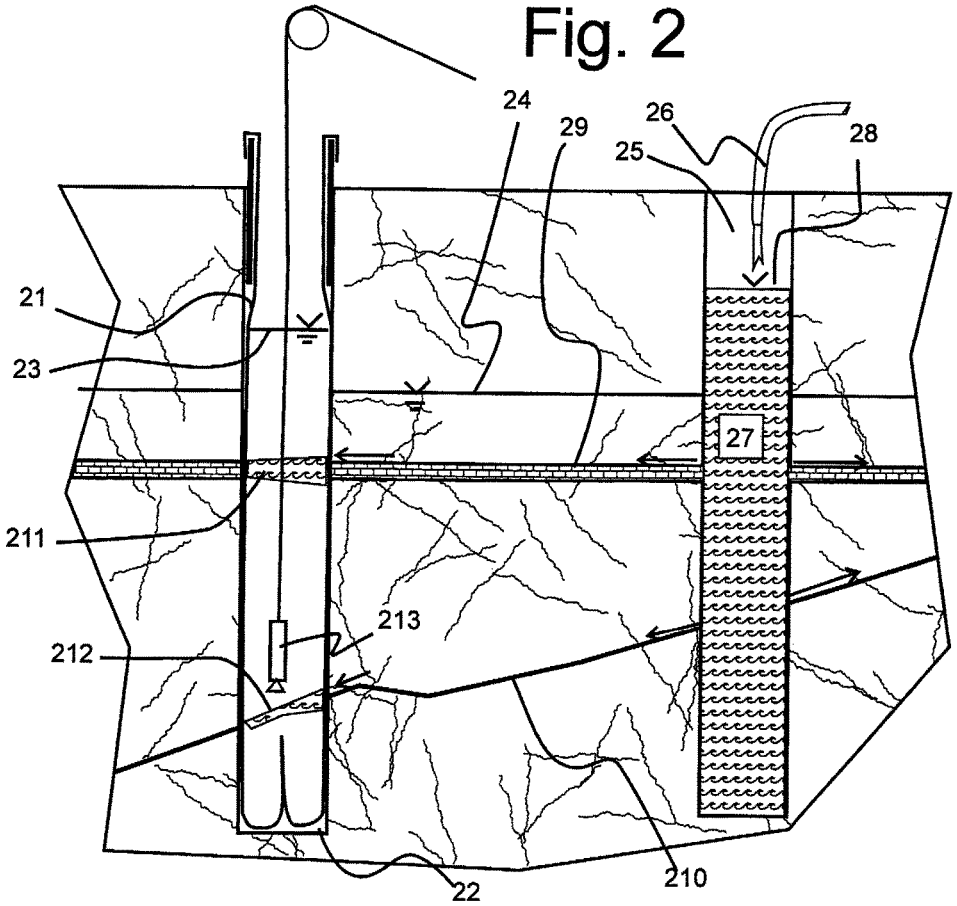
FIG. 2 is an elevation sectional schematic of the liner in place in an observation borehole, and also of an injection borehole, relative to the intermediate geologic medium containing fractures and permeable zones transmitting reactive fluid from the injection borehole to the observation borehole for camera observation.

Attention is invited to FIG. 2, showing an observation borehole 22 and a neighboring, second borehole 25 serving as an injection borehole. FIG. 2 illustrates the liner 21 fully in place, as installed and lining the observation borehole 22. The excess head in the liner 21, due to the liner fluid level 23 being a substantial elevation height above the ambient water level 24 in the surrounding geologic formation, presses the liner 21 firmly against the observation borehole wall. A transparent liner 21 allows a user to view the nature of the borehole wall by means of a camera 213 lowered within the liner; camera 213 may be submersible for use in a water-filled liner 21, or may be a more a conventional camera lowered within an air-filled liner. In all embodiments, the camera 213 may be of a type to record visible light imagery, or alternatively may be an infrared or ultraviolet camera, depending upon the type of marker fluid used and the type of reaction(s), if any, that are to occur between the arriving marker fluid flow and any liner cover. The camera 213 preferably is controllably moved (lowered and raised) within the liner interior by means of a tether cable extending from the camera to a rotatable (possible powered) reel or spool above the top of the borehole casing, as suggested in FIG. 2. There also are one or more signal wires/cables (possibly attached to the tether cable), for transmitting electronically to the surface the video or still images captured by the camera while it is down the borehole.

Such a liner 21 has been tested which has the necessary characteristics for such an application. The liner 21 has sufficient strength to support the difference in heads (e.g., between levels 23 and 24) inside and outside the liner, and to avoid puncture or other damage during installation. The liner 21 must be sufficiently transparent, or at least translucent, to allow the observation from within the liner of important features contacting the outside surface of the liner. In some situations, the liner 21 preferably is resistant to chemical attack by contaminants or other chemicals present in the subsurface geologic formation. Such a liner 21 may be composed, for example, of a strong fabric woven from transparent (or nearly transparent) polymer yarn or filament. Such a liner 21 preferably has on its inside surface a urethane layer or coating which is sufficiently transparent and has a sufficient bond strength to prevent separation of the coating from the woven fabric during eversion. Inexpensive polymer films are inadequate to serve as liners in the present apparatus, due to low strength and plastic yielding of the film during the eversion of the liner 21.

While not necessarily obviously transparent in the open air, suitable materials are available which permit a clear view of small print on objects in contact with the liner surface when completely submerged in water. The water contact with the fabric and coating reduces the refraction angle of incident light, effectively to change apparently translucent liners of appropriate composition to effectively be nearly transparent. It is often necessary, however, that the item to be viewed through the liner material be in direct contact with the outside surface of the liner 21. This observation of the ability to clearly view objects, items, or conditions on the outside of such a liner promotes beneficial utility of flexible liners according to the present apparatus and method.

Referring still to FIG. 2, the transparent liner 21 is seen in place (e.g., by previous eversion) within the observation borehole 22 proximate a second borehole 25. According to the present process, the second borehole 25 is provided with or filled with a strongly or brightly colored marker solution 27, such as potassium permanganate which has readily noticeable dark purple color. Potassium permanganate is injected into the subsurface to react with contaminants such as trichloroethylene, causing them to oxidize into less harmful compounds.

An issue to be addressed in such injection techniques is the tracking or monitoring of the subsurface traveling of the injected fluids. By locating near the injection borehole 25 at least one (possibly a plurality) observation borehole 22 with a transparent liner 21 installed therein, a user can observe the arrival, in time and space, of the potassium permanganate fluid or other marker fluid. The marker fluid 27 flows from the injection borehole 25 to the observation borehole 22 via such permeable features such one or permeable strata 29 and/or fractures or fissures 210, such flow indicated by directional arrows in FIG. 2. Upon arrival at the observation borehole 22, the marker fluid emerges from the formation and contacts the outer fabric of the coated liner 21. The contact occurs on the liner 21 adjacent that portion of the borehole wall from which the marker fluid emerged. Once in contact with the liner, the marker fluid is easily observed through the transparent liner at contact locations 211 and 212 as indicated in FIG. 2. The marker fluid may stain the exterior of the liner 21 where it contacts the liner.

The contact of the marker fluid with the liner 21, and/or staining of the liner, is observed remotely from the surface and recorded for analysis. Remote observation of the marker fluid contact with the liner preferably is accomplished by the camera 213. Camera 213 may capture still photographs, or preferably is a video camera. The camera 213 may be controllably raised and lowered, up and down to differing selected elevations, within the liner interior by means of a tether to the ground surface, as indicated in FIG. 2. Traversing the interior of the transparent liner 21 with a borehole video camera 213 permits real time remote observation of contact of the marker fluid with the exterior of the liner 21 upon the arrival of the marker fluid at the observation borehole 22, which may be accompanied by, or be manifested as, the development of marker fluid stains upon the liner exterior. This observation does not require any unique covering of the transparent liner 21 because the liner preferably has a woven fabric outer surface. (The urethane layer or coating is on the inside surface of the liner 21 as a result of the liner eversion upon installation in the observation borehole.) Accordingly, the location (i.e., on the circumference of the borehole wall), elevation, size and other visible characteristics of the marker fluid stains can be observed and recorded with a traverse of the borehole camera 213. Nevertheless, if it is desired to enhance the visibility of the arrival of the marker fluid at the observation borehole, a permeable outer covering, such as white cotton sheeting, provided on the exterior of the liner 21 allows the staining marker fluid to be wicked to dimensions larger than the mere contact of the liner exterior with, say, a thin marker fluid transmitting fracture 210.

Previously, the observation of stains developed by interaction of non-aqueous phase liquids (NAPL) with a special color-reactive cover on a flexible liner required that the liner be retrieved to the ground's surface, by inversion from the borehole, to observe the stains on the liner indicating the location of the NAPL contact. This technique, called commercially by the applicant the NAPL FLUTe system or technique, is described further hereafter. However, as time passes with a NAPL FLUTe system residing in a borehole, the stains can evolve to more stains or larger stains as the contact with the NAPL dictates. Removal of the liner thereafter, allows only the current (most recent) stain pattern on the liner cover to be observed after liner withdrawal from the borehole. It is more beneficial to observe, over a period of time, the development of the stains on the liner cover system. Thus it is useful to utilize a transparent liner covered with the reactive material, thereby to allow the observation of the stain patterns at successive times, over a designated time period, using a borehole camera 213.

Figure 3:
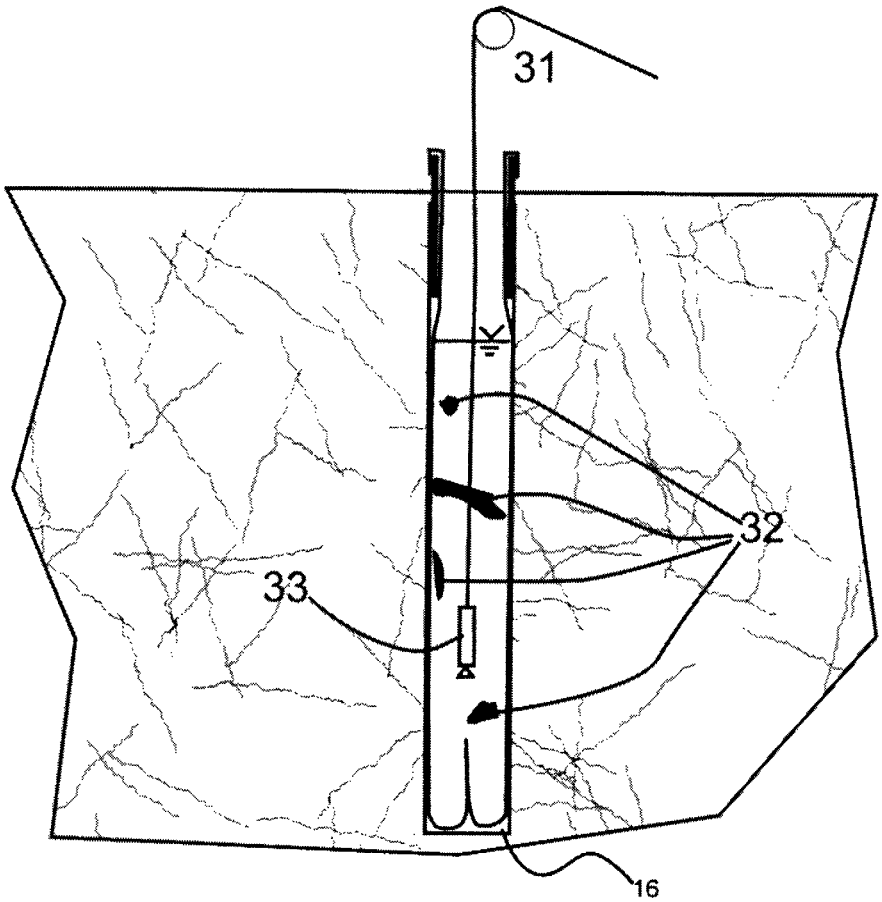
FIG. 3 is an elevation sectional schematic view of an observation borehole with a borehole camera therein, and illustrating stain patterns due to preexisting fluid reactions viewable from the liner interior.

FIG. 3 offers illustration of the type of marker fluid stains 32 on the liner (i.e., liner 21 in FIG. 2) that are normally only visible upon physical removal/retrieval of the liner from the borehole 16. The camera 33 traverses the borehole 16 (e.g., a controlled lowering of the camera from higher elevations to lower elevations in the borehole) by means of a controlled operation of a powered spool or reel 31 upon which the camera tether may be wound/unwound. The movement of the camera 23 (down or up the interior of the liner) compiles recorded visual images of marking fluid stains 32 on the liner 21 which are visible from the interior of the liner 21. A digital or analog encoder (not shown) on or in communication with the tether roller 31, tracks and records the elevation depth of the moving camera 213 within the borehole 16. Such an encoder may be in communication with a digital processor or the like to monitor and record the elevation of the camera 213 and to correlate camera location with the location of the stains 32 whose images the camera detects. Accordingly, the location, particularly the elevation, of a given stain 32 can be ascertained and logged. The process of traversing (up or down) the liner interior with the moving camera 213 can be repeated at selected designated time intervals. Repeated traversals are executed to re-record images of existing stains 32 thereby to document changes in the existing stains and, especially, to detect and document the appearance of separate "new" stains due to later marker fluid arrivals at different, "new" locations in the borehole 16. Thus a visual log of the appearance of marker fluid stains, over time, can be obtained and evaluated.

Figure 4:
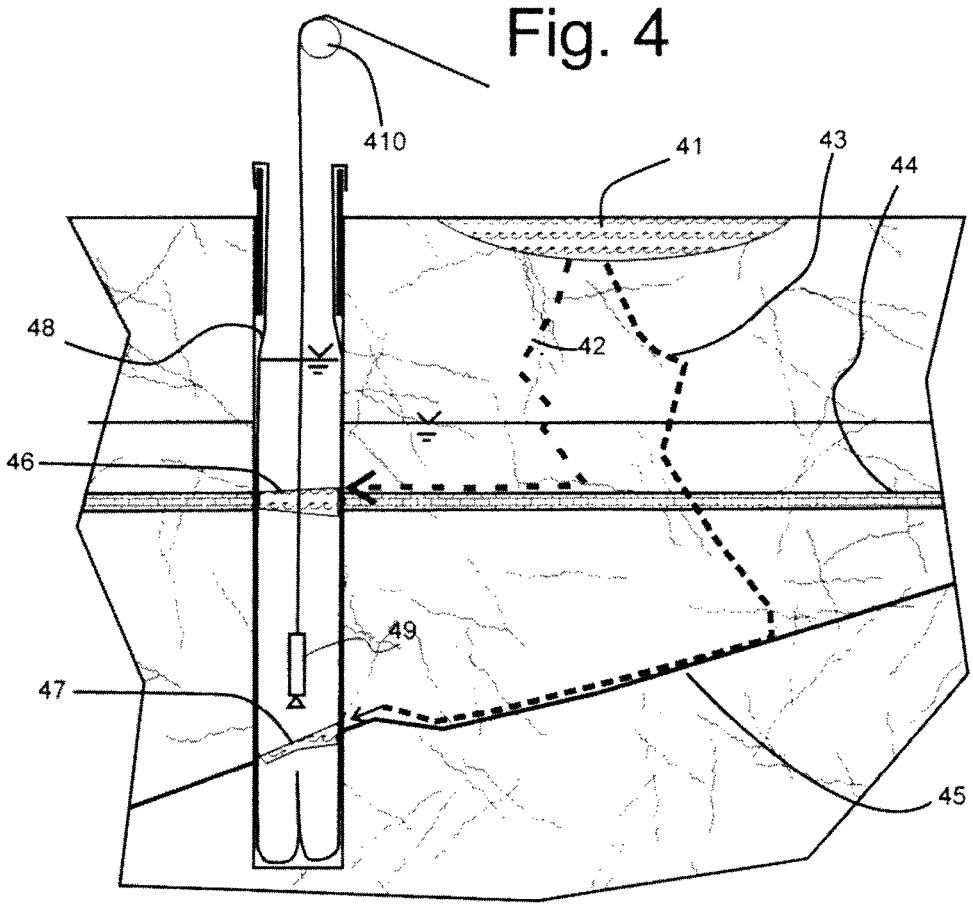
FIG. 4 is an elevation sectional schematic view of an observation borehole, showing flow of a marking fluid from the ground's surface causing stain patterns visible through the transparent liner in the borehole.

FIG. 4 illustrates an alternative use of the method and apparatus according to this disclosure. No injection borehole or deliberate supply of a marker fluid is provided; rather, the marker fluid may be a reactive or other chemical fluid (e.g., a contaminant) percolating into the ground from the surface. An observation borehole has a liner 48 installed therein as described previously herein. A camera 49 is controllably lowered and raised (traverses) the interior of a lined observation borehole, the traversal is by means of a controlled spool or roller 410. Again, a suitable means are provided in operative communication with the roller 410 to monitor the taking-up or paying-out of the tether upon which the camera 49 hangs, so as to determine the elevation of the camera within the borehole. A reactive marker fluid 41, such as creosote for example, when disposed on the Earth's surface may migrate through one or more subterranean fractures 42, 43 or 45, and/or permeable beds 44, thereby to travel to and emerge from the wall of the observation borehole (as indicated by the dashed directional arrows in FIG. 4). Upon contacting the borehole liner 48, the marker fluid causes stains 46 and 47 on the liner at the locations where the marker fluid emerges from the formation at the borehole wall. Again, the location (on the borehole's circumference), elevation, size and other visible characteristics of the stains 46, 47 are observed and recorded with a traverse of the borehole camera 49.

Figure 5:
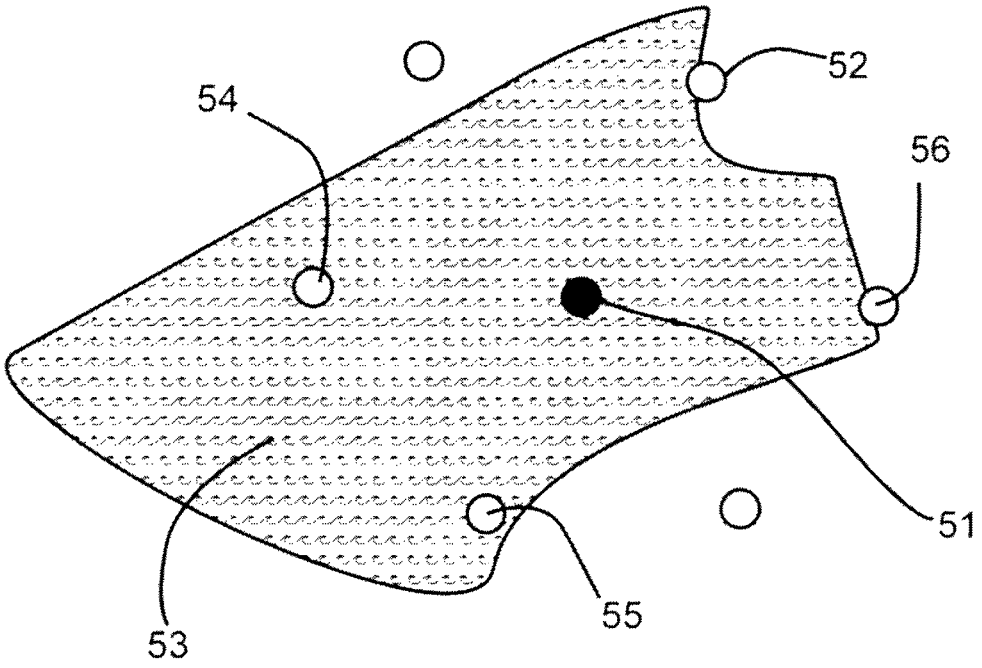
FIG. 5 is a plan schematic view of a plurality of observation wells surrounding an injection well, depicting reactive fluid flow detection according to the present disclosure.

FIG. 5 depicts schematically, in a plan view, the use of a plurality of observation boreholes 52 surrounding an injection well 51, such as may be engineered and installed at a subsurface contamination remediation site. The one or more observation boreholes 52 are located in the vicinity of the injection well 51 according to the hydrogeological engineer's plan for the "nest" of boreholes so as to best evaluate the subsurface formations. The underground flow of the marker fluid 53 is observed as it arrives at observation boreholes 52, 54, 55 56, lined with transparent liners. Were the engineer to attempt to measure the same flow arrivals using conventional water sampling procedures, samples would need to be extracted at different elevations in each observation borehole. The extraction of the sample water from different elevations in a given observation borehole often deleteriously perturbs the natural flow of the reactive fluid 53, causing disturbed samples and resulting in misleading information. Furthermore, the chemical analysis of many separate water samples required for good resolution sampling is costly. In beneficial contrast, the observation of the marker fluid flow arrivals with a borehole camera requires only the labor of lowering the camera and recording the images. Another desirable feature of using a lined observation borehole, to perform such subsurface monitoring of flow arrivals, is that the water within the interior of the liner can be and preferably is clear water, rather than the turbid, silt laden, condition of the ambient subterranean water naturally occurring in a borehole. According to the practice of the invention, a user can view through the clear water (by remote camera) the texture and color of the surrounding geologic formation where the transparent liner contacts the borehole wall.

Attention is now invited to FIGS. 6*a* and 6*b*, showing in more detail how the NAPL FLUTe color reactive cover functions. The cover is used to detect the presence of a variety of non-aqueous phase liquids (NAPLs) such as trichloroethylene (TCE), perchloroethylene (PCE), coal oil, coal tar, gasoline, creosote, and other liquids (particularly groundwater contaminants) that do not readily mix with water. The NAPL FLUTe cover is a hydrophobic thin cover material (~1 mil thickness), and may be a woven or non-woven fabric. FIG. 6*a* is a view of the outside of an isolated portion of the hydrophobic cover 61; it is understood that the cover preferably is provided on the circumference of, and along the complete length of, the flexible liner. The NAPL FLUTe hydrophobic covering 61 is disposed upon (e.g. adhered or otherwise securely mounted upon) the liner such that, after the liner has been everted into a borehole, it is the outside surface of the liner—that is, the covering is the liner surface that is pressed into contact with the borehole wall. The cover 61 is striped on its outside surface facing the borehole wall, with red 62, blue 63 and black 64 dye stripes. The stripes 62, 63, 64 typically are continuously longitudinal along the length of the liner, such that they are generally vertical within the borehole after the liner has been everted. The stripes 62, 63, 64 may be spaced apart at, for example, at one-eighth-inch (0.32 cm) intervals.

Those NAPLs which are strong solvents dissolve the dye(s) of the stripes 62, 63, 64 and carry dye(s) into, and through, the thin material of the cover 61. This transport of the dye to the other side, i.e., the inside 65 of the hydrophobic cover 61 causes the formation of a visible stain 66 of the mixture of the dyes on the white inside surface 65 of the cover material, as indicated in FIG. 6*b*. Such strong stains are easily observed through the transparent liner, which under the pressure head of the water within the liner urges the cover 61 against the borehole wall. The NAPLs thus are wicked into the cover 61 from the geologic formation pore space surrounding the borehole, or from the subsurface fractures through which the NAPLs traveled in the ground water. A large portion of the NAPL compounds are called Dense Non Aqueous Phase Liquids, DNAPLs because they are denser than water and sink deeply into aquifers.

Figure 7:
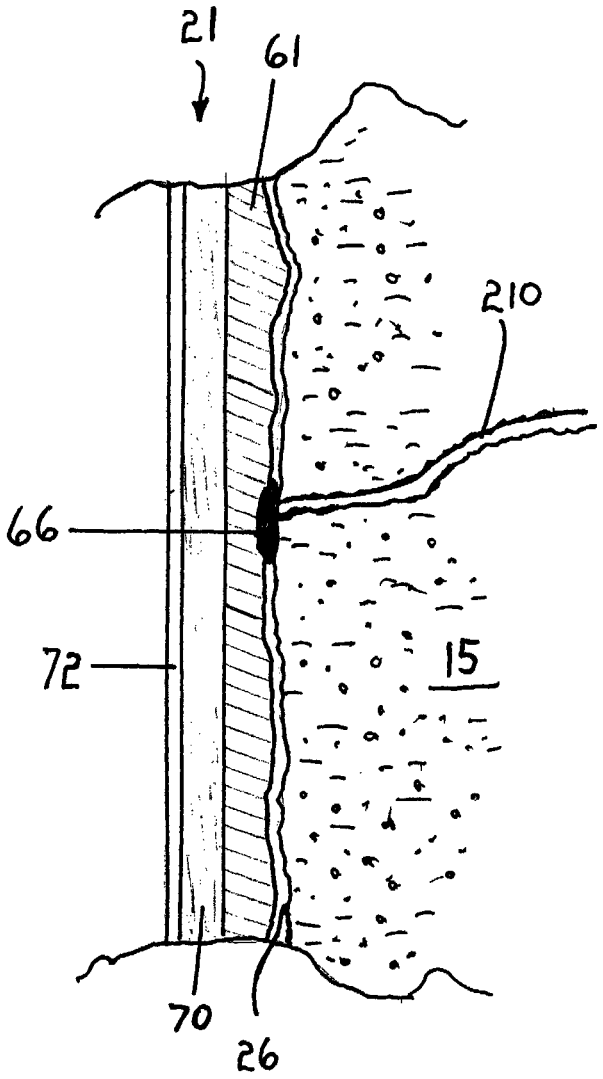
FIG. 7 is an enlarged side sectional view of a portion of an everted liner against a borehole wall, according to the present invention.

FIG. 7 is an enlarged sectional side view (not necessarily to scale) of a portion of the present apparatus installed in a borehole. The liner 21 after eversion into the borehole has its cover 61 pressed into contact with the borehole wall 26. It is seen that in preferred embodiments the liner 21 features three layers: the substantially transparent intermediate layer 70 is the layer that provides main structural integrity to the liner 21. As mentioned previously, the flexible intermediate layer 70 preferably is fabricated from a material woven from transparent or lightly translucent polymer fibers or filaments, and thus is strong yet permits light (visible, infrared, or ultraviolet, as selected) to pass there-through. The interior surface layer 72 of the liner 21 preferably is a substantially transparent urethane coating. The interior surface layer 72 is the layer that is contacted by the driving fluid (typically clear water) that fills the liner interior during the practice of the invention. The cover layer 61 (which need not be transparent) of the liner 21 is the layer that interacts with marker fluid flow arrivals, which flows may arrive at the borehole wall 26 via a fracture or fissure 210 in the nearby environment of geologic formation 15. The marker fluid penetrates or stains or reacts with the cover layer 61 to cause the stain 66 that is visible (by camera) from the liner interior, the intermediate layer 70 and the interior surface layer 72 being substantially transparent. This, it is to be understood that the transparent liner 21 has transparent layers 70 and 72, which permit a stain 66 to be visible from within the liner interior, despite that the cover 21 may not itself be substantially transparent (e.g., it may be a white fabric).

The cover 61 is composed of a material that may be stained by the fluid marker arriving at the fissure 210. The cover 61 may be provide with dye strips (stripes 62, 63, 64 in FIG. 6*a*) as described herein above, for generating a visible satin 66 if needed in the event the arriving marker fluid does not itself generate a visible stain. The cover 61 in various alternative embodiments may be infused with, contain, or be composed of special materials selected and provided to interact chemically with the arriving marker fluid to provide a reaction stain 66. The special materials may be selected from those known in the art to provide a reaction visible (including infrared and ultraviolet) on or in the material of the cover 61. By way of non-limiting example, the cover 61 may have therein a chemical, in the manner of litmus paper, which reacts with arriving marker fluid to display a visible stain whose color correlates with the pH (acid or basic) condition of the arriving fluid flow. Or, the cover 61 may react with predetermined (injected) or anticipated types of arriving marker fluids to generate a stain 66 that is fluorescent or luminescent in the presence of ultraviolet light or other impinging light energy of selected wavelengths.

Also and accordingly, special types or compositions of liner covers 61 can be used in accordance herewith to react with the geologic formation 15 then to be viewed, by camera, through the transparent liner 21. For example, a liner cover 61 may contain specialized materials to react directly with subsurface features, such as particular ore bodies found at or near the borehole wall. Or liner covers 61 comprising materials devised to react with certain fluids in the formation, such as heated water, or fluids of variable pH reacting with a litmus paper type of covering, which produce changes visible with an ordinary camera or a special purpose camera which can detect radiation wavelengths differing from that of ordinary light, may be used with the transparent liner 21. An infrared camera, for example may detect through the liner 21 arriving fluid flows of differing temperatures. Yet further, a specialized liner cover 21 may be used that reacts with particular fluids to initiate an exothermal reaction thereby to produce an infrared visible pattern "stain" unique to the reaction. For example, the liner cover 21 may contain a dry powder reactive ingredient reactive with water to generate the exothermic reaction. Water contacting the liner cover wets the active ingredient to start the exothermic chemical reaction. By way of further example, for the reaction to take place, there is in the liner an active ingredient (e.g., an alloy of magnesium, typically a super-corroding Mg—Fe alloy) in the presence of a catalyst ingredient (an acid such as tartaric acid). The reaction requires an activator ingredient (e.g., a salt, such as NaCl). When the active ingredient is a Mg—Fe alloy, the reaction is generally characterized by: $Mg+2H_2O \rightarrow Mg(OH)_2+H_2+$ heat (and water vapor); the activator is salt in the arriving subsurface groundwater flow, so that the saltier the flow arrival, the more rapid or pronounced is the exothermic reaction observed by an infrared camera.

There thus is disclosed the use of a flexible, transparent borehole liner to permit observation and monitoring of the arrival of subsurface fluid (e.g. groundwater) flows at the wall of the borehole. The ability to observe reactions in time and space (e.g., the elevation in the borehole, and/or the location on the borehole circumference defined by a transverse section of the borehole) in the geologic formation, without having to remove the liner from the borehole, is a non-obvious advance in the art for several reasons. In particular, there now is permitted the installation and use in a single borehole of two differing subsurface mapping techniques with very different preferred times of exposure. For example, with a transparent liner, the presently disclosed NAPL FLUTe detection apparatus and method can be beneficially implemented within an exposure timeframe of an hour or two, while the two-week exposure time for the system of U.S. Pat. No. 7,896,578 remains undisturbed and ongoing within the same borehole.

The observation borehole is advantageously lined and permits flow arrivals and other down-hole conditions to be observed via camera, at various elevations/heights within the borehole, with minimal perturbation of the formation natural flows. The lined hole prevents mixing of the reactive fluids in the borehole water, and preserves their location in their natural flow paths for detection. By eliminating the need to draw water from the subsurface formation to monitor subsurface flows, the observed marker fluid arrivals are more nearly controlled by natural gradients, with minimal interference from the monitoring and observation means. For the same reasons, the present system and method enhances the mapping of subsurface contaminants in situ. Finally, the flexible transparent liner can be inverted from the borehole to minimize abrasion of the liner and to prevent contact of any coverings with contact of the borehole beyond where they were emplaced by eversion. The transparent liner can be used in conjunction with other flexible liner methods, already in use and disclosed in the other patents cited herein above, when the transparency is an advantage. The eversion of a transparent liner composed of a woven layer with a transparent urethane coating avoids many of the abrasion hazards known to other flexible liners. Another advantage is the ability to use special light sources such as ultraviolet to detect the presence of photo reactive contaminants, such as oils, when the camera is of a special design to detect the fluorescence of the oils. This is a known technique for use in an open hole, but better performed in a hole which is sealed by a liner to preserve the actual natural locations of the contamination.

Although the invention has been described in detail with particular reference to these preferred embodiments, other embodiments can achieve the same results. The present invention can be practiced by employing conventional materials, methodology and equipment. Accordingly, the details of such materials, equipment and methodology are not set forth herein in detail. In the previous description, specific details are set forth, such as specific materials, structures, chemicals, processes, etc., in order to provide a thorough understanding of the present invention. However, as one having ordinary skill in the art would recognize, the present invention can be practiced without resorting to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. A method for detecting flow arrivals at a borehole comprising:

everting into an observation borehole a flexible substantially transparent liner for contacting a wall of the observation borehole, until the transparent liner is installed in place within the borehole;

disposing a camera within an interior of the everted liner;

repeatedly moving the camera up and down within the interior of the installed liner; and observing with the camera, and through the transparent liner, an event or condition where the liner contacts the observation borehole wall.

2. The method of claim 1 further comprising observing with the camera changes in the event or condition.

3. The method of claim 1 further comprising observing with the camera an appearance of a new event or condition at a new location in the borehole.

4. The method of claim 1 wherein repeatedly moving the camera up and down comprises moving the camera up and down at selected time intervals, and further comprising:

providing the transparent liner with a cover layer that comes into contact with the observation borehole wall;

allowing a marker fluid to emerge from the observation borehole wall to create at least one stain on or in the cover layer;

viewing the at least one stain with the camera;

tracking and recording the elevation depth of the moving camera; and compiling a visual log of the appearance, over time, of the at least one stain.

* * * * *